US007452012B2

(12) United States Patent
Huang

(10) Patent No.: US 7,452,012 B2
(45) **Date of Patent: *Nov. 18, 2008**

(54) MULTI-FUNCTIONAL MORTISE LOCK

(75) Inventor: Richard H Huang, West Haven, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/684,815

(22) Filed: Mar. 12, 2007

(65) Prior Publication Data

US 2007/0158952 A1 Jul. 12, 2007

Related U.S. Application Data

(63) Continuation of application No. 10/811,457, filed on Mar. 26, 2004, now Pat. No. 7,188,870.

(51) Int. Cl.
*E05C 1/08* (2006.01)
*E05C 1/12* (2006.01)

(52) U.S. Cl. ..... 292/163; 292/169; 292/169.14; 292/165; 70/107; 70/110; 70/462; 70/467

(58) Field of Classification Search ..... 292/163, 292/165

See application file for complete search history.

(56) References Cited

U.S. PATENT DOCUMENTS 0,450,331 A 4/1891 Lyons
0,450,353 A 4/1891 Burgess et al.
1,099,659 A 6/1914 Mason
1,126,181 A 1/1915 Cleaver
1,168,525 A 1/1916 Lurie
1,604,946 A 10/1926 Shaw
1,706,486 A 3/1929 Gasey
1,820,565 A 8/1931 Hines
2,164,290 A 6/1939 Hurd
2,580,237 A 12/1951 McConnell
3,211,486 A 10/1965 Crandell
3,361,462 A 1/1968 Foster
3,375,687 A 4/1968 Foster
3,672,714 A 6/1972 Schultz
3,750,433 A 8/1973 Sanders
3,808,849 A 5/1974 Alexander
4,118,056 A 10/1978 Alexander
4,390,197 A 6/1983 Butts
4,459,835 A 7/1984 Hurskainen
4,572,556 A 2/1986 Foshee
4,589,691 A 5/1986 Foshee et al.
4,674,776 A 6/1987 James
4,988,133 A 1/1991 Shih (Continued)

*Primary Examiner*—Carlos Lugo
(74) *Attorney, Agent, or Firm*—DeLio & Peterson, LLC

(57) ABSTRACT

A multi-functional mortise lock that can be rapidly converted between different functions without opening the mortise lock case by installing blocking screws that extend through threaded blocking openings in a sidewall of the case and into blocking interference with moving components inside the case. The moving components include a lock/unlock lever, a latch retract lever and a spindle hub. The blocking screws are stored in threaded storage openings in the sidewall of the case. The sidewall of the case is marked adjacent to the threaded blocking openings and storage openings to identify functions that will be performed when the blocking screws are installed in one or more of the blocking openings.

29 Claims, 4 Drawing Sheets

U.S. PATENT DOCUMENTS

| | | | |
|---|---|---|---|
| 5,474,348 | A | 12/1995 | Palmer et al. |
| 5,678,870 | A | 10/1997 | Pelletier |
| 5,813,255 | A | 9/1998 | Tell, III et al. |
| 6,120,071 | A | 9/2000 | Picard et al. |
| 6,131,966 | A | 10/2000 | Hensley et al. |
| 6,174,004 | B1 | 1/2001 | Picard et al. |
| 6,282,929 | B1 | 9/2001 | Eller et al. |
| 6,393,878 | B1 | 5/2002 | Fayngersh et al. |
| 6,398,274 | B1 | 6/2002 | Huang et al. |
| 6,543,264 | B2 | 4/2003 | Frolov |

MULTI-FUNCTIONAL MORTISE LOCK

BACKGROUND OF THE INVENTION

1. Field of the Invention

This invention relates to mortise locks with multiple functions in which the functions can be changed without opening the case.

2. Description of Related Art

Mortise locks need to provide a variety of functions. For example, in some installations it is desirable to disable rotation of the outside handle while allowing the inside handle to operate normally. In other applications, it is desirable to disable permanent unlocking of the handles with the key, or to disable retraction of the latch with the key. Making these changes to the normal operation of the mortise lock has previously required partially or totally disassembling the mortise lock and rearranging or configuring the mortise lock components to achieve the desired mode of operation.

Although such changes can be made reliably by trained personnel at the factory, the task of disassembling the mortise lock is still a relatively time consuming process. Moreover disassembling the mortise lock provides opportunities for damaging the components. Additionally, components may become lost during the adjustment process. These problems are accentuated when the changes need to be made in the field by installers or maintenance personnel.

A related problem is that there are often many different functions that can be provided. These functions are typically identified by a code or function number. However, once the mortise lock case has been opened, the installer must reference one or more drawings by function number to determine the correct internal change or changes to be made. There are many opportunities to make a mistake in this process.

After internal changes have been made, the reassembled mortise lock may appear identical to the original unmodified lock. This causes problems with identifying the modified locks when multiple mortise locks are being changed or installed with different functions.

When changes are to be made to a mortise lock, modified components may be necessary. This causes difficulties if the modified components are not readily available in the field. Conversely, when a previously modified lock is to be changed to the original functionality, any previously removed components must be replaced. This is a concern because the original components are often no longer with the lock and may have become lost.

To avoid the difficulties described above, most mortise lock manufacturers modify the locks only at the factory, and do not recommend or support modifications made in the field. This policy, however, requires that the manufacturer and its distributors stock mortise locks for all the different functions offered even though the locks are substantially similar in most respects. Stocking multiple mortise locks is expensive, particularly for the less common mortise lock functions. To reduce inventory costs, some locks that provide less common functions may not be stocked by distributors, resulting in ordering delays.

Bearing in mind the problems and deficiencies of the prior art, it is therefore an object of the present invention to provide a multi-functional mortise lock in which the housing does not have to be opened in order to change lock functionality.

It is another object of the present invention to provide a multi-functional mortise lock in which multiple functions are marked on the exterior of the mortise lock adjacent to critical locations where changes are made to identify the functions performed by the lock once the changes have been made.

It is a further object of the present invention to provide a multi-functional mortise lock in which the functions performed by a modified mortise lock may be readily determined from the exterior of the mortise lock without opening the mortise lock case.

A further object of the present invention is to provide a multi-functional mortise lock in which the components required to modify the lock and to change the lock back to original functionality are kept with the lock in externally accessible locations.

Another object of the present invention is to provide a multi-functional mortise lock that can easily be changed between different functions by untrained personnel to reduce the number of different types of mortise locks providing different functions that would otherwise have to be stocked in a distribution chain.

Still other objects and advantages of the invention will in part be obvious and will in part be apparent from the specification.

SUMMARY OF THE INVENTION

The above and other objects, which will be apparent to those skilled in art, are achieved in the present invention which is directed to a multi-functional mortise lock having a casing that includes a front plate, a first sidewall and an opposed second sidewall. A latch bolt extends through the front plate and is movable with respect to the casing between an extended position and a retracted position. At least one spindle hub adapted for connection to a spindle projecting from a handle is installed in the mortise lock casing. The spindle hub moves the latch bolt to the retracted position when it is rotated.

The mortise lock also includes a latch retract lever, a control hub, an interfering member and a lock/unlock lever. The control hub is operably connected to move the latch retract lever, which, in turn, retracts the latch bolt. The control hub is also operably connected to move the lock/unlock lever, which, in turn, moves the interfering member to lock and unlock the spindle hub.

The operation of the spindle hub, the latch retract lever and the lock/unlock lever may all be modified in the preferred embodiment of the invention by installing blocking elements. The preferred embodiment allows the installation of three blocking elements corresponding to the spindle hub, the latch retract lever and the lock/unlock lever. The blocking elements may be installed individually or in combinations to achieve various functions.

A latch retract blocking element is optionally positionable to block motion of the latch retract lever. With the latch retract blocking element installed, the latch retract lever cannot be moved by the control hub to retract the latch bolt. The latch retract blocking element is preferably a screw that is installed from the exterior of the casing without removing a sidewall.

A lock/unlock blocking element is optionally positionable to block the lock/unlock lever. This prevents the control hub from moving the lock/unlock lever between the locked and unlocked positions. Again, the lock/unlock blocking element is preferably a screw that is installed from the exterior of the casing without removing a sidewall.

A spindle hub blocking element is optionally positionable to block the spindle hub and prevent rotation thereof. Blocking the spindle hub prevents a handle attached to that hub from retracting the latch bolt. The spindle hub blocking element is also preferably a screw that is installed from the exterior of the casing without removing a sidewall or otherwise opening the casing.

The blocking elements are installed in threaded blocking openings in a sidewall of the mortise lock casing such that the head of the screw remains outside the sidewall and the end of the screw extends into the casing to block motion of its associated component.

In the most highly preferred embodiment of the invention, the exterior of the sidewall is marked to identify the functions performed by the blocking elements. Storage locations are provided for the screws forming the blocking elements to ensure that they are readily available.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 2 shows function markings on the exterior of the mortise lock case sidewall.

DESCRIPTION OF THE PREFERRED EMBODIMENT(S)

In describing the preferred embodiment of the present invention, reference will be made herein to FIGS. 1-4 of the drawings in which like numerals refer to like features of the invention.

Figure 1:
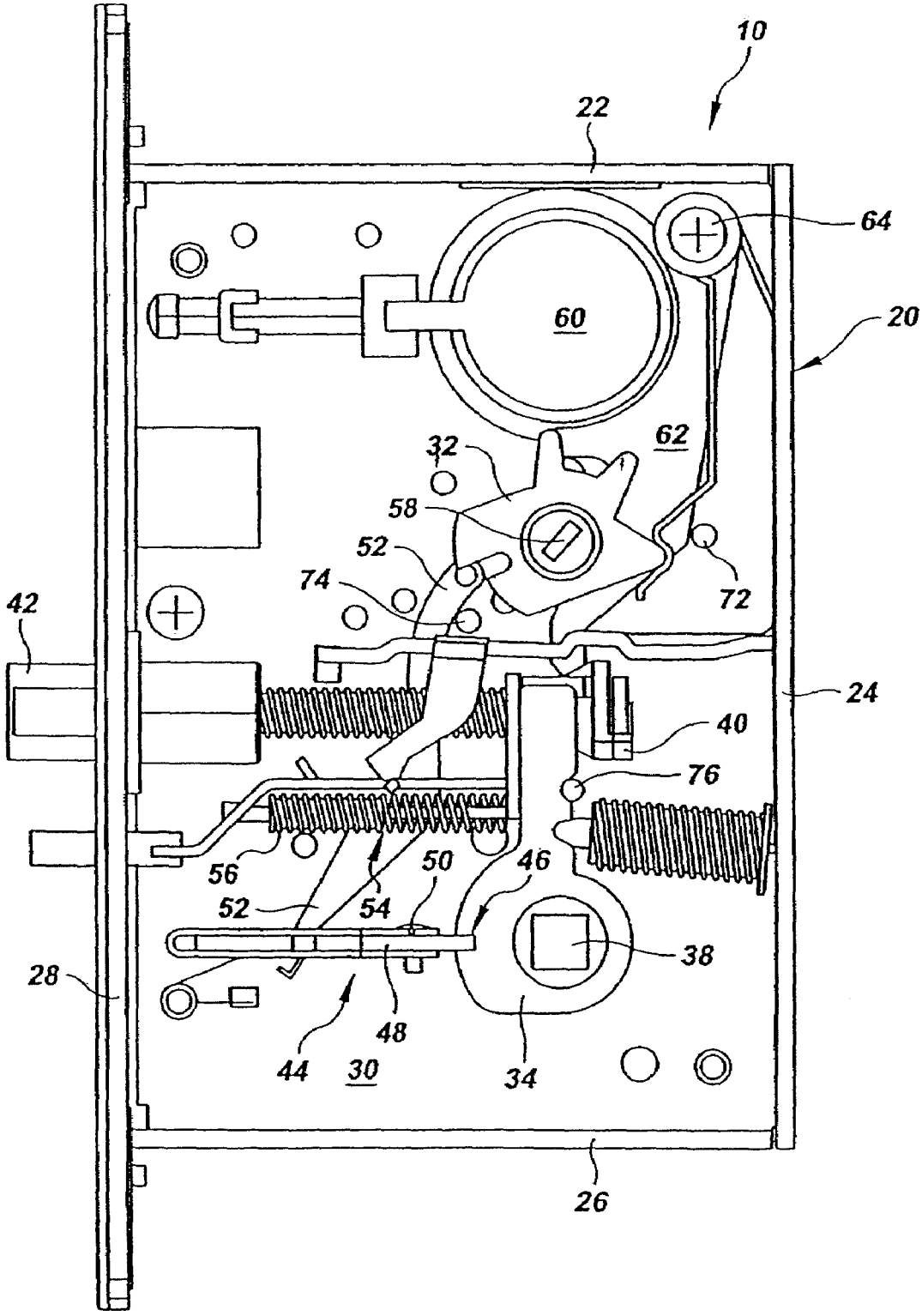
FIG. 1 is a side elevational view of a multi-functional mortise lock according to the present invention. The sidewall has been removed to expose the internal components of the mortise lock.

Referring to FIG. 1, the present invention comprises a mortise lock 10 having a casing 20 formed by a top wall 22, a back wall 24, a bottom wall 26, a front plate 28 and a pair of sidewalls 30. One sidewall is shown in the drawings. The opposite sidewall has been removed to show the internal components of the mortise lock and their relative positions and operation.

Principal components inside the mortise lock include a control hub 32, a pair of spindle hubs 34, 36 (see FIG. 3), a latch bolt 42 having a latch bolt tail 40, an interfering member 44, a lock/unlock lever 52 and a latch retract lever 62.

The spindle hubs 34, 36 can be rotated independently by inner and outer handles having spindles (not shown) that engage corresponding spindle openings 38 in each spindle hub. When a handle is rotated, its corresponding spindle rotates the associated spindle hub, which drives the latch bolt tail 40 and retracts the latch bolt 42.

The interfering member 44 slides towards and away from the front plate 28 between unlocked and locked positions to unlock and lock at least one of the spindle hubs 34, 36. When the interfering member slides away from the front plate 28, as shown in FIG. 1, it moves to the locked position and engages a notch 46 in at least one of the spindle hubs 34, 36. The engagement between notch 46 and the interfering member prevents the spindle hub with the notch from turning.

A rotatable element 48 is located on the end of interfering member 44. The rotatable element 48 turns on a shaft 50 and is shaped so that it can engage either one of the spindle hubs or both of the spindle hubs when the interfering member is in the locked position. The rotatable element 48 may be manually turned to the desired position when both of the sidewalls are installed to alter the function of the interfering member. When the interfering member slides towards the front plate 28, it is in the unlocked position and both spindle hubs are free to turn.

Lock/unlock lever 52 extends between the control hub 32 and the interfering member 44 and pivots on pivot 54 located between the control hub 32 and the interfering member 44. The lock/unlock lever 52 moves the interfering member 44 between the locked and unlocked positions under the influence of control hub 32. Pivot 54 causes the lock/unlock lever 52 to slide the interfering member 44 to the unlocked position when the control hub 32 is rotated counter clockwise in FIG. 1. The pivot for the lock/unlock lever is located behind spring 56.

Control hub 32 may be rotated by thumb latch engaging slot 58 on the axis of rotation of the control hub 32 or it may be rotated by a conventional lock cylinder (not shown) located in lock cylinder opening 60. A projection from the lock cylinder (not shown) contacts the control hub to rotate it when a key is inserted and rotated in the lock cylinder. When the control hub 32 is rotated in the clockwise direction, it drives latch retract lever 62 to retract the latch bolt 42.

One end of the latch retract lever 62 pivots on pivot 64. The opposite end of the latch retract lever contacts the tail 40 of the latch bolt 42. Clockwise rotation of the control hub 32 pivots the latch retract lever 62 on pivot 64 and retracts the latch bolt 42. This allows the latch to be retracted by either the thumb latch, which directly drives the control hub at thumb latch engaging slot 58 or with a key inserted into a lock cylinder installed in lock cylinder opening 60.

The components and their relative operation described above are all substantially similar to known mortise lock components used in the prior art as exemplified by mortise locks sold by Sargent Manufacturing Company of New Haven Conn. Similar components may be seen in U.S. Pat. No. 5,678,870, particularly including the operation of the latch bolt, the interfering member and the spindle hubs.

In order to implement certain desirable functions in mortise locks of the type described above, it has heretofore been necessary to remove one of the sidewalls and remove, replace, or modify one or more internal components. In the present invention, as more fully described below, it is not necessary to remove a sidewall to achieve these desired functions.

Figure 2:
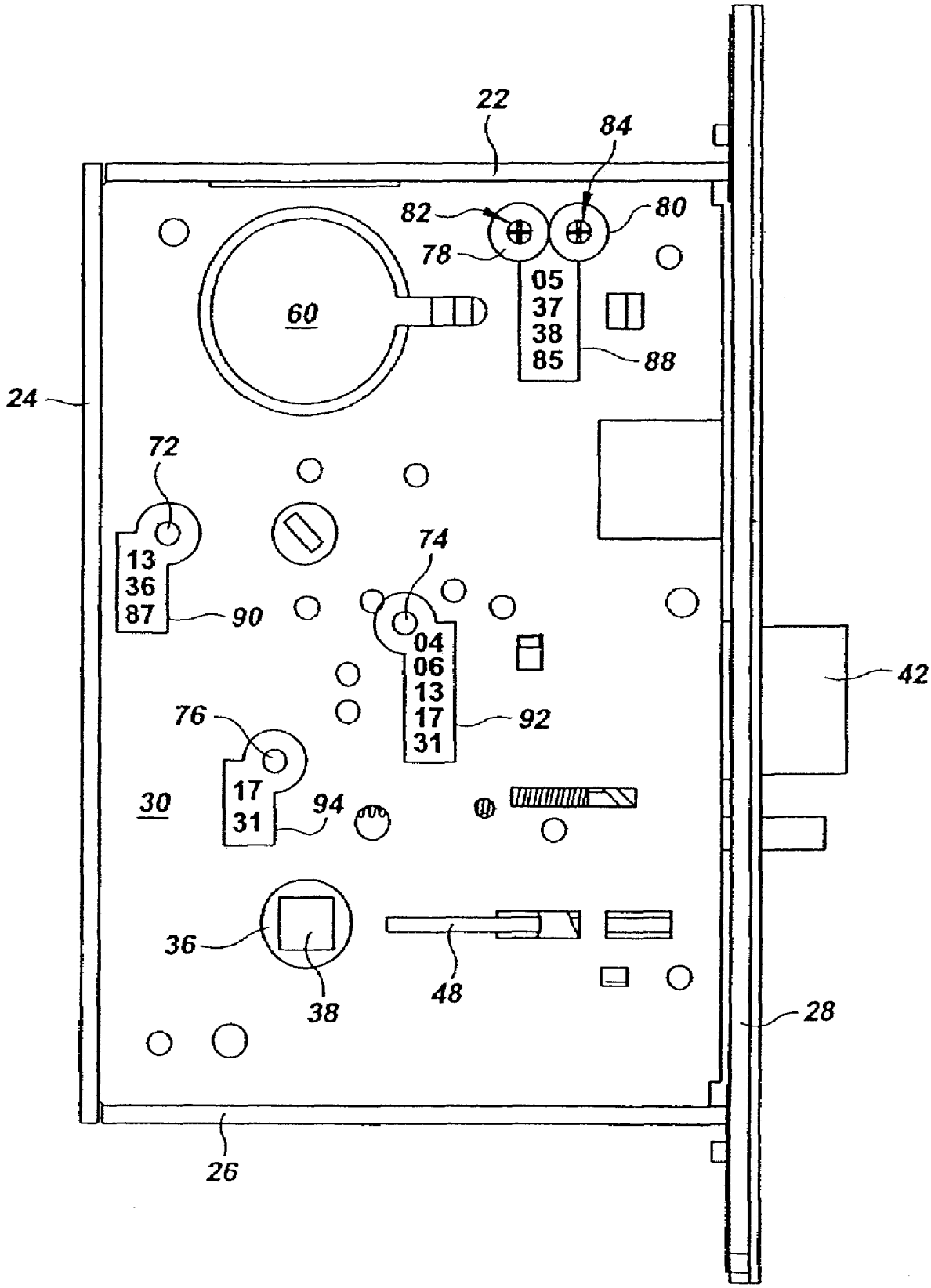
FIG. 2 is a side elevational view of the multi-functional mortise lock in FIG. 1 taken from the opposite side of FIG. 1.
Figure 3:
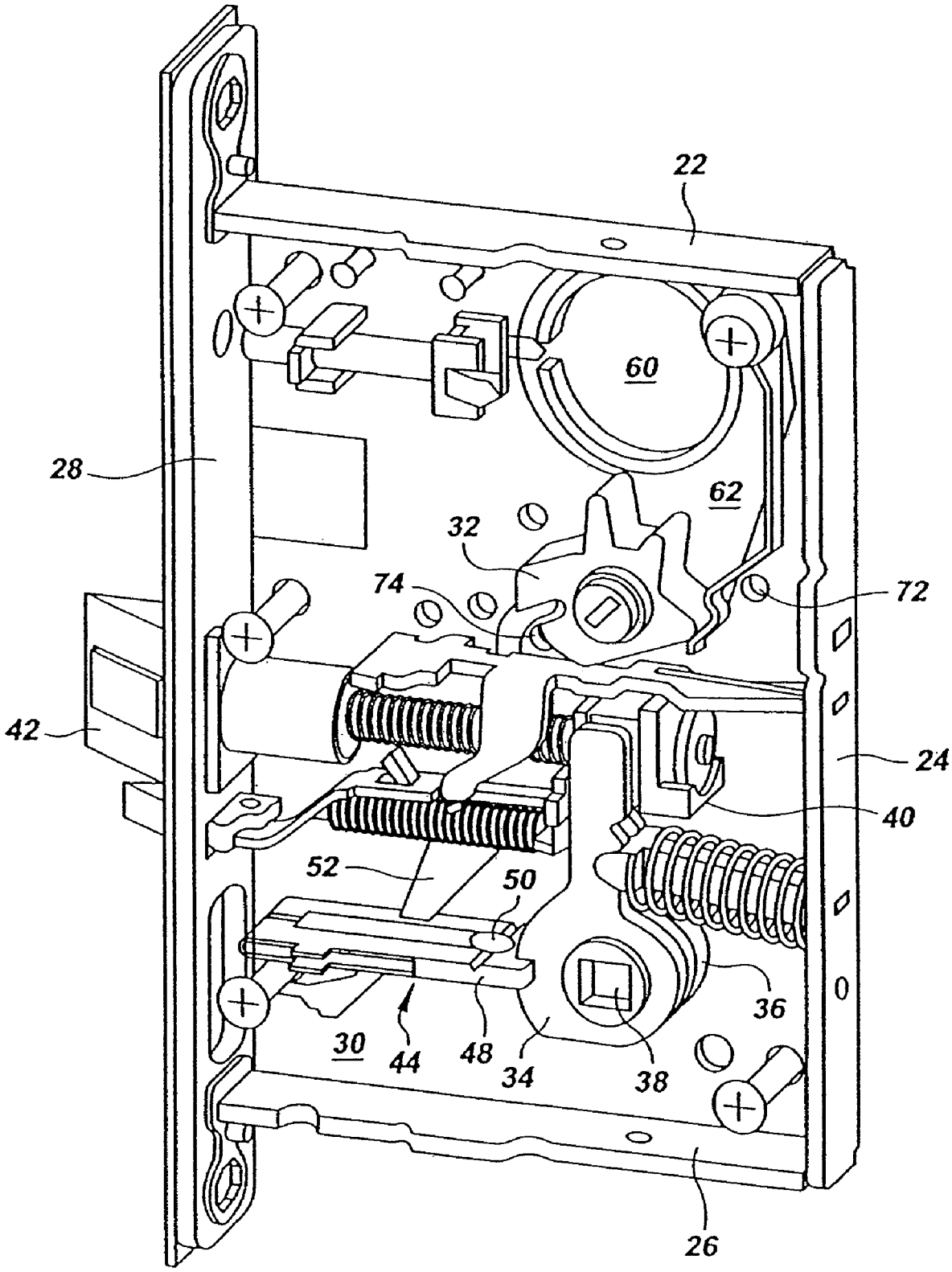
FIG. 3 is a perspective view of the multi-functional mortise lock in FIG. 1. The sidewall has been removed to expose the internal components of the mortise lock.

Referring to FIG. 2, sidewall 30 is provided with threaded blocking openings 72, 74, 76 that receive corresponding screws 78, 80 located in threaded storage openings 82, 84. When the screws 78, 80 are in the storage locations 82, 84, as illustrated in FIG. 2, the screws 78, 80 perform no function and the moving components, including the latch retract lever 62, the lock/unlock lever 52 and the spindle hub 36 operate as previously described.

However, by moving the screws 78, 80 from the storage location 82, 84 to one or more of the threaded blocking openings 72, 74 or 76, the operation of these components (latch retract lever, lock/unlock lever and spindle hub) may be blocked. When installed at one of the threaded blocking openings, the screws 78, 80 operate as corresponding "blocking elements" to block certain motions of the associated lever or hub.

Figure 4:
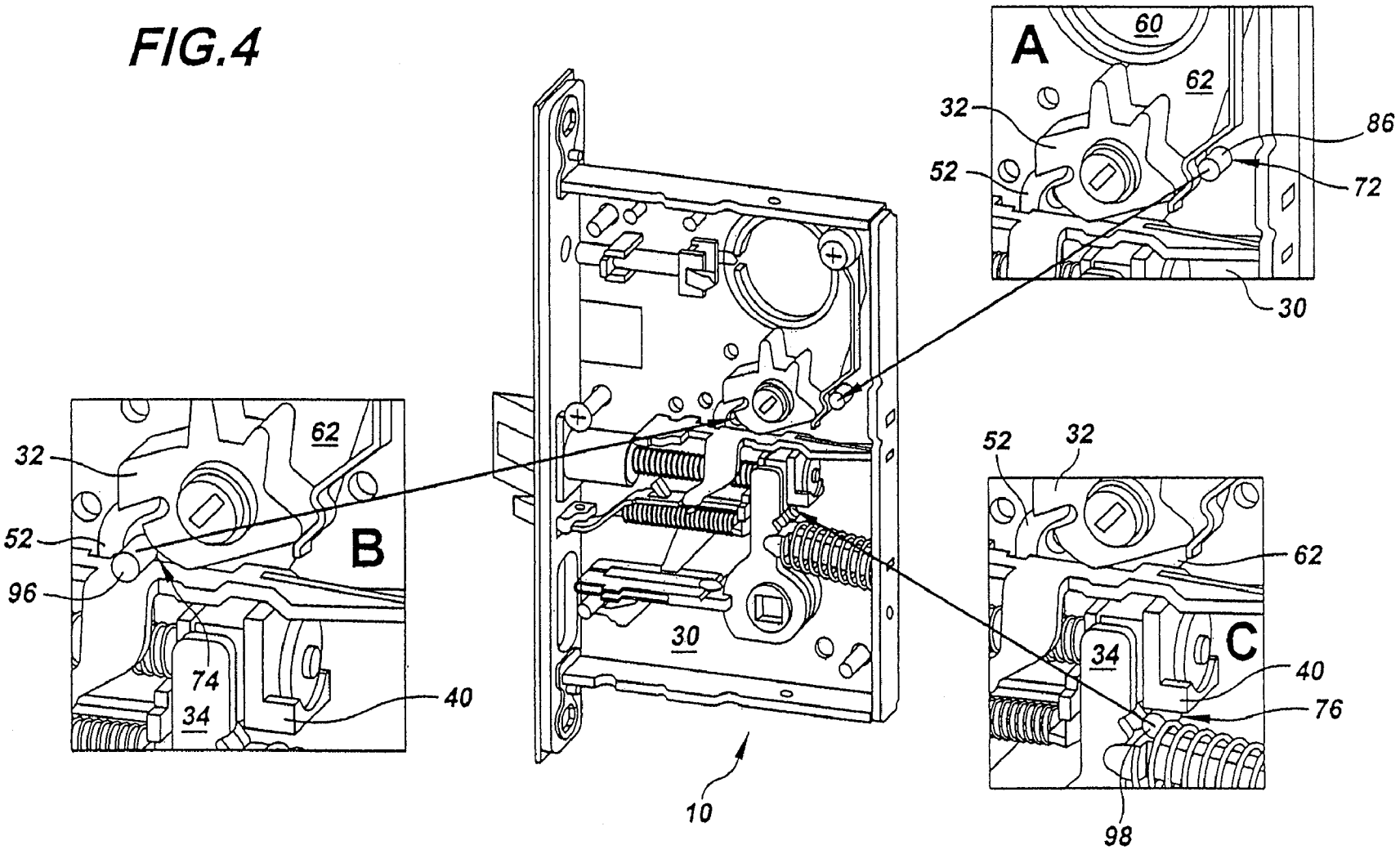
FIG. 4 is a perspective view of the multi-functional mortise lock in FIG. 1 and substantially corresponds to FIG. 3 except it includes three detail views A-C at an enlarged scale to illustrate the location of three corresponding blocking elements and their relationship to and interaction with moving components of the mortise lock.

FIG. 4 illustrates the function of the three blocking elements when installed in blocking openings 72, 74, 76 by providing three corresponding detail views "A," "B" and "C" connected by arrows pointing to the associated blocking opening in sidewall 30. When a screw 78, 80 is moved to a threaded blocking opening 72, 74 or 76, the end of the screw projects into the mortise lock through sidewall 30 and interferes with or blocks its associated hub or lever. The end of the screw is referred to as a "blocking element" and is identified by a new reference number below to identify its function.

Referring to detail view "A" in FIG. 4, the latch retract blocking element 86 projects through blocking opening 72 and prevents the latch retract lever 62 from pivoting about pivot point 64 to retract the latch bolt 42. The control hub 32 can no longer be used to retract the latch bolt 42 with the latch retract blocking element 86 installed. It should be understood that the latch retract blocking element 86 may be formed by either of the blocking screws 78 or 80. The blocking screw may be easily installed or removed and placed back into storage without the necessity for removing the sidewall 30.

As can be seen in FIG. 2, markings are provided on the sidewall 30 at locations marked with reference numbers 88, 90, 92 and 94 to indicate the functions that the mortise lock will perform when screws are installed in the corresponding locations. Function numbers are used to identify the functions. Reference number 88 refers to the function number markings "05," "37," "38" and "85." Reference number 90 refers to a second group of function numbers, "13," "36" and "87." Reference number 92 refers to a third group of function numbers, "04," "06," "13," "17" and "31." Reference number 94 refers to a fourth group of function numbers, "17," and "31 ."

The function numbers at 88 indicate conventional functions that may be performed when the latch retract lever, lock/unlock lever and spindle hub are free to operate normally. Functions "36" and "87" marked at 90 correspond to the disabling of the latch retract lever 62 by blocking element 86 installed in opening 72 as described above.

Referring to detail view "B" of FIG. 4, it can be seen that installing a blocking screw in blocking opening 74 forms a lock/unlock blocking element 96. With the lock/unlock blocking element 96 installed, the lock/unlock lever 52 can no longer pivot about pivot 54. This prevents the lock/unlock lever 52 from moving the interfering member 44 to the unlocked position (towards the front plate 28 and out of interfering engagement with one or both of the controlled hubs 34, 36).

Referring to detail view "C" of FIG. 4, installing a blocking screw in opening 76 forms a spindle hub blocking element 98 which prevents the spindle hub 36 from being turned by a handle to retract the latch bolt 42 via latch bolt tail 40. The blocking element 98 interferes only with one of the two spindle hubs.

Although the functions of the blocking elements have been individually described above, more than one blocking screw may be installed at a time to perform combined functions. In the preferred design, as may be seen in FIG. 2, the functions provided by various combinations of installed screws is marked on the exterior of the sidewall adjacent to the corresponding blocking opening. Thus, function number "17" corresponds to blocking the lock/unlock lever by installing a screw in opening 74 and blocking the spindle hub by installing a screw in opening 76. Function number "13" corresponds to blocking the lock/unlock lever by installing a screw in opening 74 and blocking the latch retract lever by installing a screw in opening 72.

It will be noted that all of the blocking screws may be installed from a single side of the mortise lock and that only that side needs to be marked with applicable function numbers. The functions performed by the lock may be readily determined by noting which screws are installed and referencing the marked function numbers adjacent thereto. The storage locations for unused blocking screws ensure that the required blocking elements are readily available at the time of initial installation and long after.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A multi-functional mortise lock comprising:

a casing having a front plate for confronting a door frame, a first sidewall and an opposed second sidewall, at least one of the sidewalls having a lock cylinder opening for receiving a lock cylinder;

a latch bolt movable with respect to the casing between an extended position and a retracted position;

at least one spindle hub adapted for connection to a spindle projecting from a handle, the at least one spindle hub acting to move the latch bolt to the retracted position when rotated;

an interfering member movable between a locked position in which the interfering member interferingly engages the at least one spindle hub to prevent rotation thereof and an unlocked position in which the interfering member is disengaged from the at least one spindle hub;

a lock/unlock lever for moving the interfering member between the locked and unlocked positions, a latch retract lever for moving the latch bolt between the extended and retracted positions;

a control hub operable by the lock cylinder, the control hub being operably connected to the lock/unlock lever to move the interfering member between the locked and unlocked positions;

the latch retract lever being operable by the lock cylinder to move the latch bolt between the extended and retracted positions;

at least one blocking element positionable through at least one blocking opening in the first sidewall to prevent the lock cylinder from operating the lock/unlock lever to move the interfering member between the locked and unlocked positions, the at least one blocking element being positionable through the at least one blocking opening without removing the first or second sidewall from the mortise lock.

2. The multi-functional mortise lock according to claim 1 wherein the at least one blocking element is alternately positionable in the at least one blocking opening and another blocking opening to alternately prevent motion of the latch retract lever and the lock/unlock lever.

3. The multi-functional mortise lock according to claim 1 wherein the at least one blocking element is removably mounted relative to the first sidewall.

4. The multi-functional mortise lock according to claim 1 further including a spindle hub blocking element positionable to block the at least one spindle hub to prevent rotation thereof, the spindle hub blocking element being positionable without removing the first or second sidewall from the mortise lock.

5. The multi-functional mortise lock according to claim 4 wherein the at least one blocking element and the spindle hub blocking element are removably mounted relative to the first sidewall.

6. The multi-functional mortise lock according to claim 1 wherein the at least one blocking opening in the first sidewall is a latch retract blocking opening and the at least one blocking element is a screw extending through the latch retract blocking opening into blocking engagement with the latch retract lever, the at least one blocking screw being removable from outside the mortise lock.

7. The multi-functional mortise lock according to claim 6 wherein the multi-functional mortise lock includes a storage opening for storing the at least one blocking element.

8. The multi-functional mortise lock according to claim 7 wherein the multi-functional mortise lock is marked at the at least one blocking opening to identify a function performed by the at least one blocking element.

9. A multi-functional mortise lock comprising:

a casing having a front plate for confronting a door frame, a first sidewall and an opposed second sidewall, at least one of the sidewalls having a lock/unlock blocking opening and a lock cylinder opening for receiving a lock cylinder;

a latch bolt movable with respect to the casing between an extended position and a retracted position;

at least one spindle hub adapted for connection to a spindle projecting from a handle, the at least one spindle hub acting to move the latch bolt to the retracted position when rotated;

an interfering member movable between a locked position in which the interfering member interferingly engages the at least one spindle hub to prevent rotation thereof and an unlocked position in which the interfering member is disengaged from the at least one spindle hub;

a lock/unlock lever for moving the interfering member between the locked and unlocked positions;

a control hub operable by the lock cylinder, the control hub being operably connected to the lock/unlock lever to move the interfering member between the locked and unlocked positions; and a lock/unlock blocking element positionable to prevent motion of the lock/unlock lever between the locked and unlocked positions, the lock/unlock blocking element being positionable without removing the first or second sidewall from the mortise lock;

wherein the lock/unlock blocking element is inserted through the lock/unlock blocking opening to prevent the lock/unlock lever from moving the interfering member between the locked and unlocked positions and the lock/unlock blocking element is removable from outside the multi-functional mortise lock without removing the first or second sidewall.

10. The multi-functional mortise lock according to claim 9 wherein the lock/unlock blocking element is a screw extending through the lock/unlock blocking opening to prevent the lock/unlock lever from moving the interfering member between the locked and unlocked positions, the lock/unlock blocking screw being removable from outside the mortise lock.

11. The multi-functional mortise lock according to claim 10 wherein the multi-functional mortise lock includes a lock/unlock storage opening for storing the lock/unlock blocking screw.

12. The multi-functional mortise lock according to claim 10 wherein the multi-functional mortise lock is marked at the lock/unlock blocking opening to identify a function performed by the lock/unlock blocking screw when moved from the lock/unlock storage opening to the lock/unlock blocking opening.

13. The multi-functional mortise lock according to claim 10 wherein the multi-functional mortise lock is marked at the lock/unlock blocking opening and the lock/unlock storage opening with corresponding marks to identify a function performed by the lock/unlock blocking screw when moved from the lock/unlock storage opening to the lock/unlock blocking opening.

14. A multi-functional mortise lock comprising:

a casing having a front plate for confronting a door frame, a first sidewall and an opposed second sidewall, at least one of the sidewalls having a lock cylinder opening for receiving a lock cylinder;

a latch bolt movable with respect to the casing between an extended position and a retracted position;

at least one spindle hub adapted for connection to a spindle projecting from a handle, the at least one spindle hub acting to move the latch bolt to the retracted position when rotated;

an interfering member movable between a locked position in which the interfering member interferingly engages the at least one spindle hub to prevent rotation thereof and an unlocked position in which the interfering member is disengaged from the at least one spindle hub;

a lock/unlock lever for moving the interfering member between the locked and unlocked positions, a control hub operable by the lock cylinder, the control hub being operably connected to the lock/unlock lever to move the interfering member between the locked and unlocked positions; and at least one blocking element positionable in alternative positions to block the at least one spindle hub to prevent rotation thereof or to prevent the lock/unlock lever from moving the interfering member between the locked and unlocked positions, the at least one blocking element being positionable without removing the first or second sidewall from the mortise lock.

15. The multi-functional mortise lock according to claim 14 wherein the first sidewall includes a spindle hub blocking opening and the at least one blocking element is a screw extending through the spindle hub blocking opening into blocking engagement with the at least one spindle hub, the at least one blocking screw being removable from outside the mortise lock.

16. The multi-functional mortise lock according to claim 15 wherein the first sidewall includes a storage opening for storing the at least one blocking screw.

17. The multi-functional mortise lock according to claim 15 wherein the first sidewall is marked at the spindle hub blocking opening to identify a function performed by the at least one blocking screw.

18. The multi-functional mortise lock according to claim 15 wherein the first sidewall is marked at the spindle hub blocking opening and the storage opening with corresponding marks to identify a function performed by the at least one blocking screw.

19. A multi-functional mortise lock comprising:

a casing having a front plate for confronting a door frame, a first sidewall and an opposed second sidewall, at least one of the sidewalls having a lock cylinder opening for receiving a lock cylinder operated by a key and at least two blocking openings;

a latch bolt movable with respect to the casing between an extended position and a retracted position;

at least one spindle hub adapted for connection to a spindle projecting from a handle, the at least one spindle hub acting to move the latch bolt to the retracted position when rotated;

a latch retract lever for moving the latch bolt between the extended and retracted positions;

an interfering member movable between a locked position in which the interfering member interferingly engages the at least one spindle hub to prevent rotation thereof and an unlocked position in which the interfering member is disengaged from the at least one spindle hub;

a lock/unlock lever for moving the interfering member between the locked and unlocked positions;

a control hub operated by the lock cylinder and operably connected to the lock/unlock lever to move the interfering member between the locked and unlocked positions;

at least one blocking element positionable through the at least two blocking openings without removing the first or second sidewall from the mortise lock, the at least one blocking element being positionable to block motion of at least two multi-functional lock components selected from the group consisting of the latch retract lever, the lock/unlock lever and the spindle hub.

20. The multi-functional mortise lock according to claim 19 wherein:

the at least two blocking openings comprise:

a threaded latch retract blocking opening a threaded lock/unlock blocking opening, and a threaded spindle hub blocking opening; and the at least one blocking element is selected from the group consisting of:

a latch retract blocking element comprising a screw extending through the latch retract blocking opening into blocking engagement with the latch retract lever, the latch retract blocking screw being removable from outside the mortise lock to unblock the latch retract lever;

a lock/unlock blocking element comprising a screw extending through the lock/unlock blocking opening into blocking engagement with the lock/unlock lever, the lock/unlock blocking screw being removable from outside the mortise lock to unblock the lock/unlock lever; and a spindle hub blocking element comprising a screw extending through the spindle hub blocking opening into blocking engagement with the at least one spindle hub, the spindle hub blocking screw being removable from outside the mortise lock to unblock the at least one spindle hub.

21. The multi-functional mortise lock according to claim 20 wherein the first sidewall further includes:

a threaded latch retract storage opening for storing the latch retract blocking screw when the latch retract lever is not being blocked;

a threaded lock/unlock storage opening for storing the lock/unlock blocking screw when the lock/unlock lever is not being blocked; and a threaded spindle hub storage opening for storing the spindle hub blocking screw when the at least one spindle hub is not being blocked.

22. The multi-functional mortise lock according to claim 20 wherein the first sidewall is marked at the threaded blocking openings to identify functions performed by the blocking screws when moved from the storage openings to the blocking openings.

23. The multi-functional mortise lock according to claim 20 wherein the first sidewall is marked at the threaded blocking openings and the threaded storage openings with corresponding marks to identify functions performed by the blocking screws when moved from the storage openings to the blocking openings.

24. The multi-functional mortise lock according to claim 22 wherein the marks indicate functions performed by combinations of blocking screws and functions performed by individual blocking screws.

25. A multi-functional mortise lock comprising:

a casing having a front plate for confronting a door frame, a first sidewall and an opposed second sidewall, at least one of the sidewalls having a lock cylinder opening for receiving a lock cylinder;

a latch bolt movable with respect to the casing between an extended position and a retracted position;

a first spindle hub adapted for connection to a spindle projecting from a first handle, the first spindle hub acting to move the latch bolt to the retracted position when rotated;

a second spindle hub adapted for connection to a spindle projecting from a second handle, the second spindle hub acting to move the latch bolt to the retracted position when rotated;

a latch retract lever for moving the latch bolt between the extended and retracted positions;

an interfering member movable between a locked position in which the interfering member interferingly engages at least one of the spindle hubs to prevent rotation thereof and an unlocked position in which the interfering member is disengaged from the spindle hubs;

a lock/unlock lever for moving the interfering member between the locked and unlocked positions;

a control hub operable by the lock cylinder, the control hub being operably connected to the latch retract lever to move the latch bolt between the extended and retracted positions and operably connected to the lock/unlock lever to move the interfering member between the locked and unlocked positions;

a latch retract blocking screw removably mounted on the first sidewall and extending through the first sidewall, the latch retract blocking screw blocking the latch retract lever when mounted to the first sidewall to prevent the control hub from retracting the latch bolt, the latch retract blocking screw being removable from the first sidewall without removing the first or second sidewall from the mortise lock;

a lock/unlock blocking screw removably mounted on the first sidewall and extending through the first sidewall, the lock/unlock blocking screw blocking the lock/unlock lever to prevent the control hub from moving the lock/unlock lever between the locked and unlocked positions, the lock/unlock blocking screw being removable from the first sidewall without removing the first or second sidewall from the mortise lock; and a spindle hub blocking screw removably mounted on the first sidewall and extending through the first sidewall, the spindle hub blocking screw blocking the first spindle hub to prevent rotation thereof, the spindle hub blocking screw being removable from the first sidewall without removing the first or second sidewall from the mortise lock.

26. The multi-functional mortise lock according to claim 25 wherein:

the first sidewall further includes:

a threaded latch retract blocking opening a threaded lock/unlock blocking opening, and a threaded spindle hub blocking opening;

the latch retract blocking element is a screw extending through the latch retract blocking opening into blocking engagement with the latch retract lever, the latch retract blocking screw being removable from outside the mortise lock to unblock the latch retract lever;

the lock/unlock blocking element is a screw extending through the lock/unlock blocking opening into blocking engagement with the lock/unlock lever, the lock/unlock blocking screw being removable from outside the mortise lock to unblock the lock/unlock lever; and the spindle hub blocking element is a screw extending through the spindle hub blocking opening into blocking engagement with the first spindle hub, the spindle hub blocking screw being removable from outside the mortise lock to unblock the first spindle hub.

27. The multi-functional mortise lock according to claim 26 wherein the first sidewall further includes:

a threaded latch retract storage opening for storing the latch retract blocking screw when the latch retract lever is not being blocked;

a threaded lock/unlock storage opening for storing the lock/unlock blocking screw when the lock/unlock lever is not being blocked; and a threaded spindle hub storage opening for storing the spindle hub blocking screw when the first spindle hub is not being blocked.

28. The multi-functional mortise lock according to claim 27 wherein the first sidewall is marked at the threaded blocking openings to identify functions performed by the blocking screws when moved from the storage openings to the blocking openings.

29. The multi-functional mortise lock according to claim 27 wherein the first sidewall is marked at the threaded blocking openings and the threaded storage openings with corresponding marks to identify functions performed by the blocking screws when moved from the storage openings to the blocking openings.

* * * * *